United States Patent [19]

Schewe

[11] Patent Number: 4,890,368

[45] Date of Patent: Jan. 2, 1990

[54] WARPER WITH TENSION ISOLATOR AND TENSION CONTROLLER

[75] Inventor: Richard A. Schewe, Loves Park, Ill.

[73] Assignee: Reed-Chatwood, Inc., Rockford, Ill.

[21] Appl. No.: 250,534

[22] Filed: Sep. 29, 1988

[51] Int. Cl.[4] ..... D02H 13/14; B65H 59/00

[52] U.S. Cl. ..... 28/185; 28/194

[58] Field of Search ..... 28/185, 194

[56] References Cited

U.S. PATENT DOCUMENTS

| | | | |
|---|---|---|---|
| 3,497,927 | 3/1970 | Norton | 28/194 |
| 3,699,809 | 10/1972 | Komatsu . | |

FOREIGN PATENT DOCUMENTS

| | | | |
|---|---|---|---|
| 1143371 | 2/1963 | Fed. Rep. of Germany | 28/185 |
| 2130020 | 12/1972 | Fed. Rep. of Germany | 28/185 |
| 46-42058 | 12/1971 | Japan | 28/185 |
| 47-28413 | 7/1972 | Japan | 28/185 |
| 1036479 | 7/1966 | United Kingdom | 28/185 |
| 1238184 | 7/1971 | United Kingdom | 28/185 |

*Primary Examiner*—Werner H. Schroeder
*Assistant Examiner*—Jodi Tokar
*Attorney, Agent, or Firm*—Leydig, Voit & Mayer, Ltd.

[57] ABSTRACT

A textile machine in the form of a warper for drawing multiple strands from a creel and for winding the strands on a rotatable beam which forms part of the warper. Located between the creel and the beam is a strand guide and tension isolator comprising a motor-driven delivery roller and two nip rollers. Load cells are associated with one of the nip rollers and produce signals which vary substantially linearly as a function of changes in the tension of the strands between the final nip roller and the beam. The load cell signals are used to control the drive motor for the delivery roller so as to cause the motor to reduce the torque applied to the delivery roller when the tension increases and to increase the torque applied to the delivery roller when the tension decreases.

8 Claims, 3 Drawing Sheets

WARPER WITH TENSION ISOLATOR AND TENSION CONTROLLER

BACKGROUND OF THE INVENTION

This invention relates generally to a textile machine and, more particularly, to a warper for drawing multiple textile strands from a supply such as a creel and for winding the strands on a rotatable drum or beam.

In such a warper, rollers are located between the creel and the beam to guide the strands from the creel to the beam. One of the rollers is a delivery roller and is rotated by a motor which causes the roller to draw strands from the creel and to supply the strands to the beam. Two nip rollers are tangent to the delivery roller and coact with the latter to guide the strands and to isolate the tension in the strands at the beam from the tension of the strands at the creel. If a strand breaks, brakes associated with the beam and the delivery roller automatically bring the two to a stop in order to enable the machine operator to repair the break.

It is important to maintain a substantially constant tension in the strands being wound on the beam. An increase in the tension at the beam will result in an increase in the density of the strands wound on the beam because the high tension causes the strands to pack tightly on the beam. Conversely, a decrease in the tension will cause the density of the strands on the beam to decrease.

Various arrangements have been provided to control the tension of the strands at the beam. One of the more common arrangements involves controlling the torque applied by the delivery roll motor to the delivery roll so as to reduce the torque if the tension at the beam increases and to increase the torque if the tension at the beam decreases. Conventionally, the delivery roll motor is controlled by sensing the current drawn by the motor and by changing the power input to the motor as a function of changes in such current. This type of control system, however, lacks accuracy since changes in current result only in a rough approximation of changes in strand tension. Changes in motor current are not only dependent upon changes in tension but also upon extraneous factors such as belt slippage and variations in other intervening drive components between the motor and the delivery roller.

SUMMARY OF THE INVENTION

The general aim of the present invention is to provide a warper with a new and improved system for more directly sensing the tension in the strands approaching the beam and for more accurately controlling the delivery roller drive motor so as to maintain a more uniform tension at the beam.

A more detailed object of the invention is to achieve the foregoing by sensing the force imposed on the final nip roll by the strands and by controlling the torque applied to the delivery roll as a function of changes in such force.

Still another object of the invention is to mount the final nip roll to swing toward and away from the delivery roll, to produce a signal representative of the force imposed on the nip roll by the strands and to use such signal to control the torque applied to the delivery roll by the delivery roll motor.

These and other objects and advantages of the invention will become more apparent from the following detailed description when taken in conjunction with the accompanying drawings.

DETAILED DESCRIPTION OF THE PREFERRED EMBODIMENT

Figure 1:
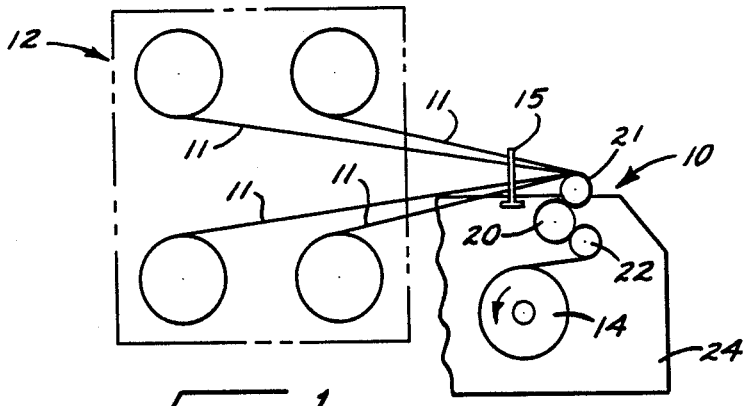
FIG. 1 is a schematic view of a textile machine equipped with a new and improved tension isolator and tension controller incorporating the unique features of the present invention.

For purposes of illustration the present invention has been shown in the drawings as being embodied in a textile machine 10 and more particularly in a warper for drawing textile strands 11 from a supply such as a creel 12 and for winding the strands tightly around a large roller or beam 14 which forms part of the warper. While the present warper 10 may be used with strands of various materials, it is particularly suitable for use with very delicate strands such as filaments made of glass or of delicate fiber.

As shown schematically in FIG. 1, the beam 14 of the warper 10 is supported to turn about a horizontal axis and is rotated in a conventional manner and in a counterclockwise direction about that axis by a drive motor (not shown). During rotation of the beam 14, multiple strands 11 are drawn from the creel 12, pass through a comb 15 and then are wound tightly around the beam.

Figure 2:
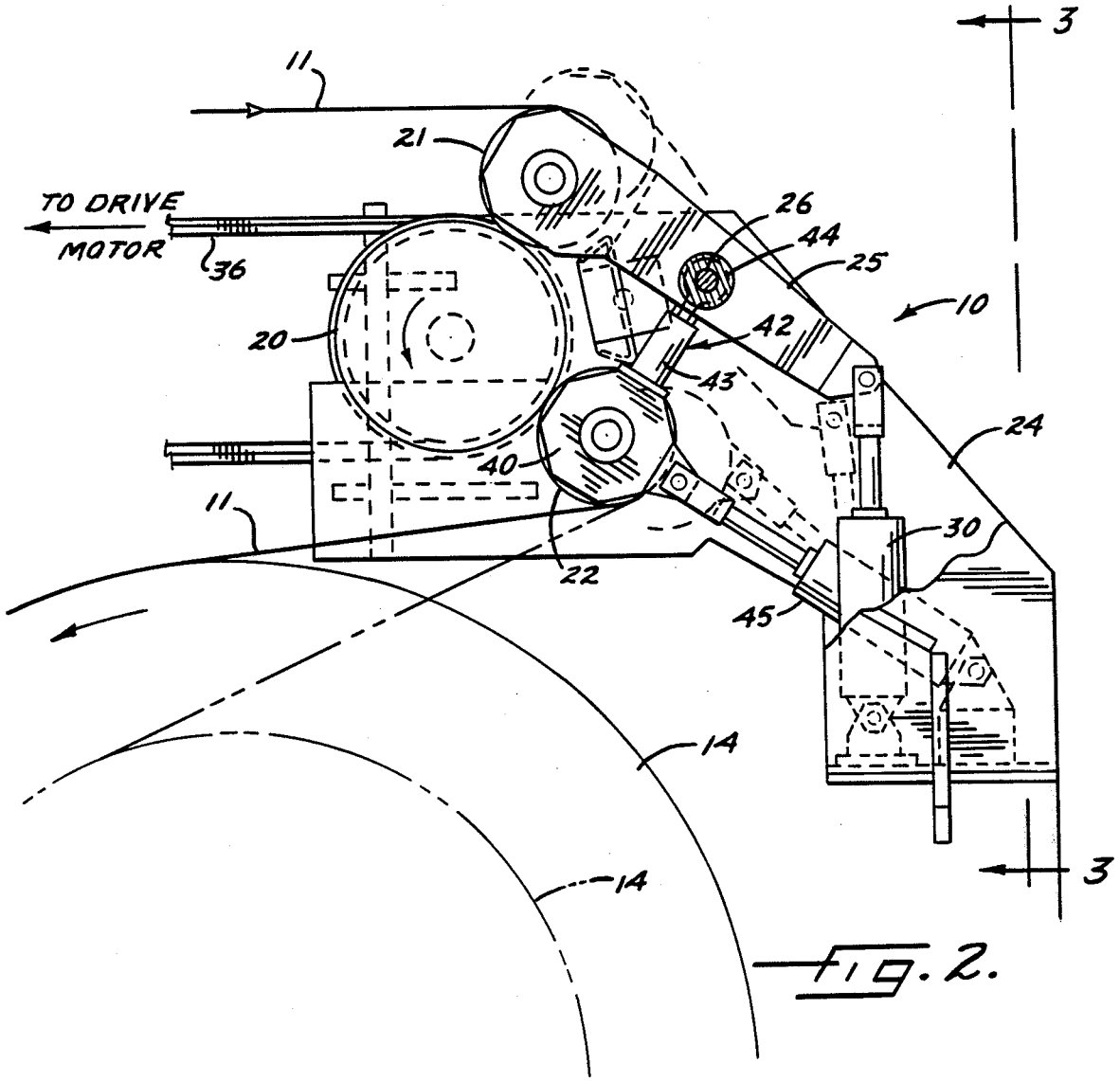
FIG. 2 is a side elevational view of the tension isolator and tension controller as taken substantially along the line 2—2 of FIG. 3, certain parts being broken away and shown in section.
Figure 3:
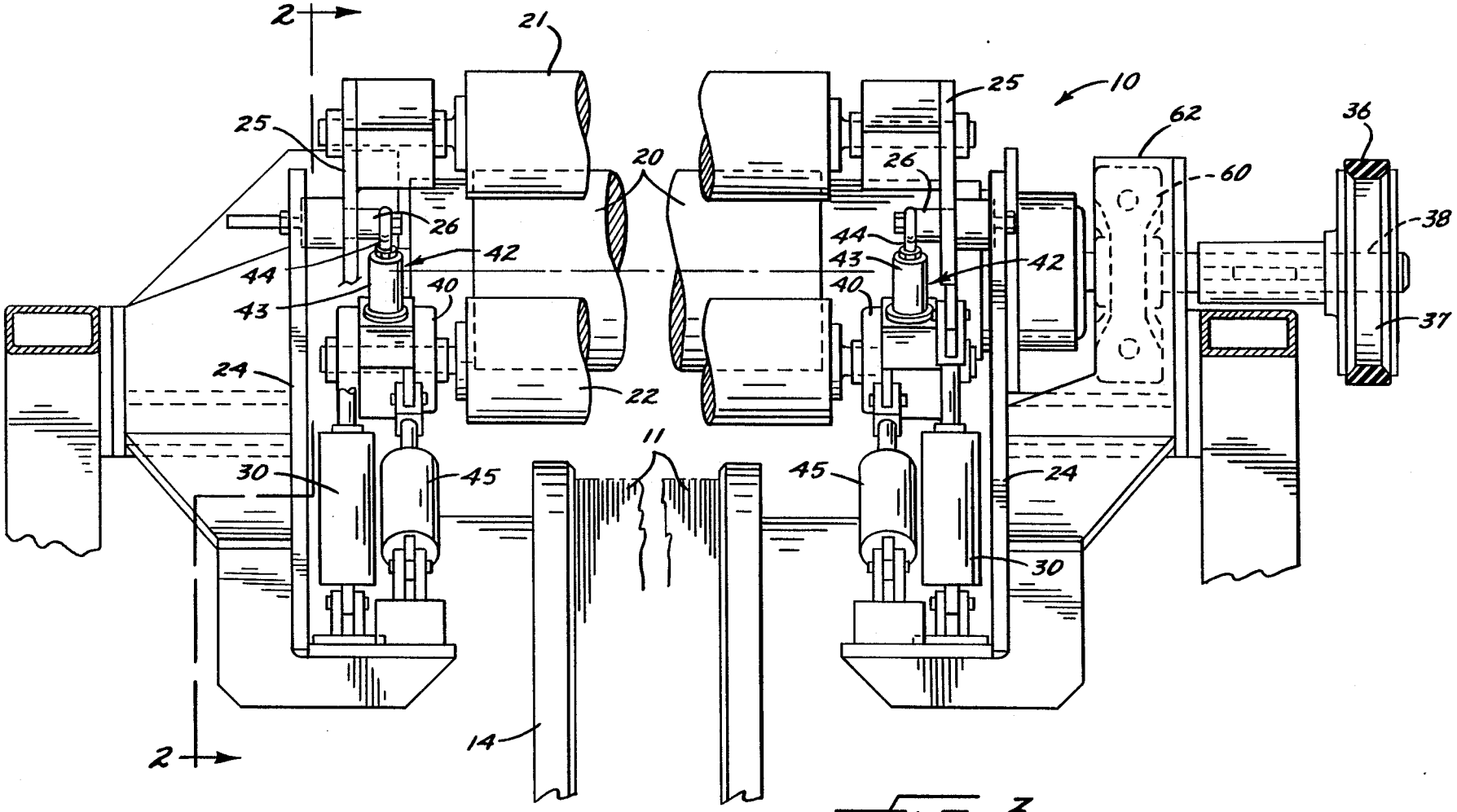
FIG. 3 is a front elevational view of the tension isolator and tension controller as taken substantially along the line 3—3 of FIG. 2.

Means are provided for guiding the strands 11 from the creel 12 to the beam 14 and for isolating the tension in the strands at the beam from the tension in the strands at the creel. Herein, these means comprise a delivery roller 20 and two nip rollers 21 and 22, all three rollers being supported to rotate about laterally spaced axes extending parallel to the rotational axis of the beam. The delivery roller 20 is spaced above the beam 14 at about a one o'clock position relative to the beam as viewed in FIGS. 1 and 2 and is supported by frame members 24 (FIG. 3) located near the ends of the delivery roller. The two nip rollers 21 and 22 are located at the front side of the delivery roller 20 and are in tangential relation with the delivery roller at approximately one o'clock and four o'clock positions, respectively.

Strands 11 from the creel 12 extend forwardly around the nip roll 21, rearwardly from the nip roll 21 to the delivery roll 20, forwardly from the delivery roll to the nip roll 22 and then rearwardly from the nip roll 22 to the beam 20. Two downwardly and forwardly inclined arms 25 at the end portions of the nip roll 21 rotatably support that nip roll for rotation adjacent the upper ends of the arms. Between their ends, the arms are supported to swing about horizontal pivot axes defined by two horizontal pivot rods 26 secured rigidly to the frame members 24. Reciprocating pneumatic actuators 30 are pivotally connected to the frame members and to the lower end portions of the arms 25. The actuators normally press the nip roll 21 against the strands 11 on the delivery roll 20. When the rods of the actuators are retracted, the arms are rocked clockwise about the pivots 26 to pull the nip roll 21 away from the delivery roll 20 as shown in phantom in FIG. 2 and enable the initial threading of strands between the two rolls. The mounting of the nip roll 22 will be described subsequently.

Figure 4:
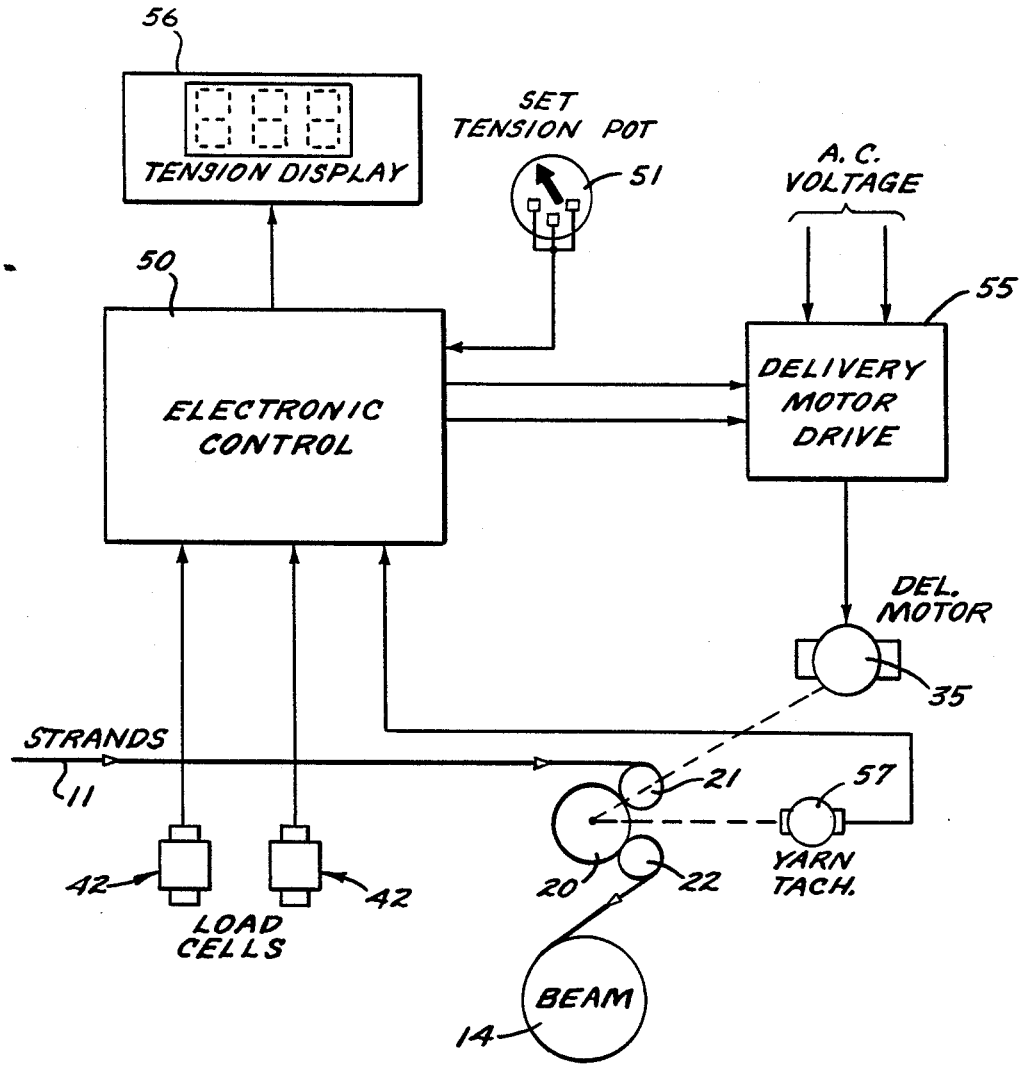
FIG. 4 is a schematic view of electrical components for controlling the delivery roll.

The delivery roll 20 is power-rotated about its axis by a d.c. motor 35 (FIG. 4) which acts through a drive belt 36 (FIGS. 2 and 3) to rotate a sheave 37 (FIG. 3) on a shaft 38 extending from one end of the delivery roll. As the delivery roll 20 rotates, the nip rolls 21 and 22 press the strands 11 against the delivery roll to cause the delivery roll to draw the strands from the creel 12 for subsequent winding around the beam 14. The action of the nip rolls pressing the strands against the delivery roll also serves to isolate the tension in the strands downstream of the nip roll 22 from the tension of the strands upstream of the nip roll 21.

The tension in the strands between the nip roll 22 and the beam 14 should be maintained at a substantially constant magnitude in order to create a pack of substantially uniform density on the beam. In accordance with the primary aspect of the present invention, the tension of the strands between the nip roll 22 and the beam 14 is controlled by sensing the force imposed by the strands on the nip roll 22 and by varying the torque, applied to the delivery roll 20 by the motor 35 as a function of changes in such force. The force imposed by the strands on the nip roll 22 varies virtually linearly as a function of changes in the tension of the strands between that nip roll and the beam and may be converted to a signal for controlling the torque applied to the delivery roll in such a manner as to accurately maintain a tension of desired value between the final nip roll and the beam.

More specifically, the nip roll 22 is mounted to rotate within bearing housings 40 (FIGS. 2 and 3) located near the ends of the nip roll. The nip roll 22 is supported to swing toward and away from the delivery roll 20 and, in carrying out the invention, force-to-electrical signal transducer means are provided for detecting the force imposed on the nip roll 22 by the strands 11. In this particular instance, the transducer means are in the form of load cells 42 (FIGS. 2 to 4) located near the ends of the nip roll 22. The load cells may be of the type sold under the trade designation "Sensotec Model RF". Each load cell includes a housing portion 43 connected rigidly to the adjacent bearing housing 40 and further includes a rod portion 44 movable within the housing portion and having a free end connected pivotally to the adjacent pivot rod 26. Reciprocating pneumatic actuators 45 are connected pivotally between the frame members 24 and the bearing housings 40 and are normally operable to rock the nip roll 22 clockwise about the pivot rods 26 and into pressing engagement with the strands 11 on the delivery roll 20. Retraction of the rods of the actuators 45 causes the nip roll 22 to swing counterclockwise about the pivot rods 26 and away from the delivery roll 20 so as to enable initial threading of strands 11 between the delivery roll 20 and the nip roll 22.

With the foregoing arrangement, an increase in the tension in the strands between the nip roll 22 and the beam 14 results in a greater force acting on the nip roll 22 and causes the magnitude of the electrical signals produced by the load cells 42 to change in one direction (e.g., to become larger). Conversely, a decrease in the tension of the strands reduces the force on the nip roll 22 and causes the load cell signals to change in the opposite direction (e.g., to become smaller). The signals produced by the load cells change virtually linearly as a function of changes in the tension of the strands between the nip roll 22 and the beam 14 and are used to control the delivery roll motor 35 in such a manner as to keep the tension substantially constant.

For this purpose, the output signals from the load cells 42 are routed as parallel inputs to an electronic control 50 (FIG. 4) which is operable to average the signals to create a resultant input signal representative of the actual tension in the strands 11. A command signal representative of desired tension in the strands forms a second input to the electronic control 50 and is established by the setting of a manually adjustable potentiometer 51. In essence, the electronic control 50 is a conventional comparator which produces an error or output signal that changes in magnitude whenever the combined signal of the load cells 42 is not in agreement with the command signal dialed in on the potentiometer 51. The output signal from the control 50 changes in magnitude in one direction when the actual tension signal as produced by the load cells becomes higher than the commanded tension signal from the potentiometer. Conversely, the output signal changes in magnitude in the opposite direction when the actual tension signal becomes lower than the command signal. Accordingly, the output signal is representative of the difference or error between the commanded tension and the actual tension existing in any given time.

The output signal from the control 50 forms an input signal to a delivery motor drive 55 (FIG. 4) operable to convert a source of a.c. line voltage into d.c. voltage for energizing the motor 35. The delivery motor drive 55 also amplifies the output signal from the control 50 and controls the power input to the motor in such a manner as to reduce the output or error signal to zero. In other words, if the actual tension as detected by the load cells 42 exceeds the desired tension dialed in on the potentiometer 51, the output signal from the control 50 reduces the power supplied to the motor 35 so as to cause the motor to apply less torque to the delivery roll 20 and thereby reduce the tension of the strands to a value where the actual tension equals the desired tension. If the actual tension falls below the set value, the control 50 increases the power supplied to the drive 50 so as to increase the torque applied to the roll 20 by the motor 35 until the tension has been increased to the desired value. In this way, the tension between the nip roll 22 and the beam 14 is kept at a substantially constant value. Such tension may be read on a digital display 56 (FIG. 4) which receives its input from the control 50.

An additional output signal from the control 50 may be routed to the delivery motor drive 55 in order to bias the error signal and compensate for such factors as changes in the angle at which the strands 11 leave the nip roll 22. As the diameter of the beam 14 increases due to winding of the strands 11, the angle at which the strands leave the nip roll 22 changes (compare the full line and phantom line illustrations in FIG. 2) and thus the force imposed on the nip roll by the strands changes even though the strand tension itself may tend to remain constant. As the diameter of the beam increases, the linear speed of the strands decreases and such decrease is detected by a tachometer 57 (FIG. 4) whose output forms an electrical input to the control 50 in order to compensate for the changing angle of the strands.

From the foregoing, it will be apparent that the present invention brings to the art a new and improved warper 10 in which the actual tension in the strands is sensed directly by the load cells 42 with the signals produced thereby being used to control the torque applied to the delivery roll 20. As a result of directly sensing the tension in the strands, the delivery roll may be controlled more precisely so as to enable the tension to be maintained at a more nearly constant value.

I claim:

1. A textile machine having a beam rotatable about a predetermined axis and adapted to wind strands delivered to the beam from a supply, said beam being operable when rotated to draw strands from said supply, and means located between said beam and said supply for guiding said strands to said beam, for isolating the tension in the strands at the supply from the tension of the strands at the beam and for controlling the tension of the strands at the beam, said means comprising first, second and third rollers rotatable about laterally spaced axes paralleling the axis of said beam, said strands being guided around said first roller to said second roller, being guided around said second roller to said third roller and being guided around said third roller to said beam, said first and third rollers being substantially tangent to said second roller and in contact with the strands thereon, means connected to said third roller and operable in response to changes in force exerted on said third roller by said strands to produce a signal which varies as a function of changes in tension of the strands between said third roller and said beam, a drive for rotating said second roller and means responsive to said signal for causing the torque applied by said drive to said second roller to change as a function of changes in said signal.

2. A textile machine as defined in claim 1 in which said third roller is supported to swing toward and away from said second roller about a pivot axis paralleling the axis of rotation of said third roller, said signal producing means comprising a load cell having a first portion swingable with said third roller and having a second portion movable relative to said first portion and supported to turn about said pivot axis.

3. A textile machine as defined in claim 2 in which said first roller is supported to swing toward and away from said second roller about said pivot axis.

4. A textile machine as defined in claim 3 further including selectively operable means for swinging said first and third rollers away from said second roller to enable strands to be threaded between said second roller and the other two rollers.

5. A textile machine as defined in claim 1 in which said signal producing means comprise load cells located adjacent opposite ends of said third roller.

6. A textile machine having a beam rotatable about a predetermined axis and adapted to wind strands delivered to the beam from a supply, said beam being operable when rotated to draw strands from said supply, and means located between said beam and said supply for guiding said strands from said supply to said beam, for isolating the tension in the strands at the beam from the tension of the strands at the supply, and for controlling the tension of the strands at the beam, said means comprising first, second and third rollers rotatable about laterally spaced axes paralleling the axis of said beam, said first and third rollers being substantially tangent to said second roller, said strands being guided around said first roller to said second roller, being guided around said second roller to said third roller and being guided around said third roller to said beam, means supporting said third roller to swing toward and away from said second roller about an axis paralleling that of the third roller, a load cell connected to said third roller and operable in response to swinging of said third roller about said pivot axis to produce a signal which varies as a function of changes in the tension of the strands between said third roller and said beam, an electrical motor for rotating said second roller and operable to apply variable torque to said second roller, and means responsive to said signal from said load cell for causing the torque applied to said second roller by said motor to change as a function of changes in said signal.

7. A textile machine as defined in claim 6 in which said first roller also is supported to swing toward and away from said second roller about said pivot axis, and selectively operable means for swinging said first and third rollers away from said second roller to enable strands to be threaded between said second roller and the other two rollers.

8. A textile machine as defined in claim 6 in which said load cell is located adjacent one end portion of said third roller, and a second load cell located adjacent the opposite end portion of said third roller and operable to produce a signal in response to swinging of said third roller about said pivot axis.

* * * * *